US006186371B1

(12) United States Patent
de Pous et al.

(10) Patent No.: US 6,186,371 B1
(45) Date of Patent: Feb. 13, 2001

(54) FIXED-SPRAY DISPENSING DEVICE

(75) Inventors: Olivier de Pous, Paris; Stéphane Jumel, Remy, both of (FR)

(73) Assignee: Valois S.A., Le Neubourg (FR)

( * ) Notice: Under 35 U.S.C. 154(b), the term of this patent shall be extended for 0 days.

(21) Appl. No.: 09/180,060

(22) PCT Filed: May 6, 1997

(86) PCT No.: PCT/FR97/00807

§ 371 Date: Jan. 25, 1999

§ 102(e) Date: Jan. 25, 1999

(87) PCT Pub. No.: WO97/41964

PCT Pub. Date: Nov. 13, 1997

(30) Foreign Application Priority Data

May 7, 1996 (FR) ..... 96 05681

(51) Int. Cl.[7] ..... B67D 5/40
(52) U.S. Cl. ..... 222/380; 222/385
(58) Field of Search ..... 222/321.1, 321.2, 222/321.7, 321.8, 383.1, 380, 385

(56) References Cited

U.S. PATENT DOCUMENTS

| | | | |
|---|---|---|---|
| 3,333,549 | | 8/1967 | Cooprider . |
| 3,379,381 | | 4/1968 | Decaux . |
| 3,640,274 | | 2/1972 | Costello . |
| 4,215,804 | * | 8/1980 | Giuffredi ..... 222/321.7 |
| 4,271,990 | | 6/1981 | Kutik et al. . |
| 4,410,107 | * | 10/1983 | Corsette ..... 222/321.7 |
| 4,860,933 | | 8/1989 | Morane . |

FOREIGN PATENT DOCUMENTS

| | | |
|---|---|---|
| 10 33 600 | 7/1958 | (DE) . |
| 298 847 | 9/1989 | (EP) . |
| 1430 243 | 1/1960 | (FR) . |
| 1292 289 | 3/1962 | (FR) . |
| 1353 050 | 1/1964 | (FR) . |
| 2157 694 | 6/1973 | (FR) . |

* cited by examiner

*Primary Examiner*—Kevin Shaver
*Assistant Examiner*—David Deal
(74) *Attorney, Agent, or Firm*—Rockey, Milnamow & Katz, Ltd.

(57) ABSTRACT

A device for dispensing a fluid material from a container, including a conventional pump or valve comprising a fixed body in which an actuating rod (11) is movable between an inoperative position and a dispensing position, said rod (11) being hollow so that it defines a discharge channel (15) providing fluid communication between at least one part of said fluid material and outlets (12) on the rod; and a dispensing member (3) secured to said body and provided with a fixed dispensing outlet (20) and means (31, 34) for providing fluid communication between said movable outlets (12) and the fixed dispensing outlet (20), at least in the dispensing position, as well as a push button (13) mounted on the actuating rod (11) for sealing the top end of the discharge channel (15).

3 Claims, 2 Drawing Sheets

FIXED-SPRAY DISPENSING DEVICE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention concerns a dispensing device of fluid product with a liquid to pasty consistency contained in a container, said dispensing device dispensing fluid product in the form of a fixed spray.

2. Description of the Related Art

"Fixed spray" is understood to mean a jet of fluid product in sprayed form that is not displaced during actuating of the device. In fact, most of the dispensing devices are actuated by transfer displacement with a button incorporating the nozzle which is acted upon with a finger or an actuating device. The steadiness of the spray is therefore taken by comparison with the container. The fixed spray dispensing devices, which may or may not be a simple pump or with precompression or a measuring valve, can for example find usefulness in the applications connected with pharmacology in which the precision of the jet is important.

Fixed spray dispensing devices are already known from the prior art, for example from documents U.S. Pat. No. 4,218,198, FR-A-2015035, WO 93/03857 or U.S. Pat. No. 4,227,628. In these devices of the prior art, the actuating of the button makes a plunger descend into a chamber that is provided in the lower part of a valve device that communicates with a discharge channel. The complexity of this type of dispensing device is due to the steadiness of the spray; the escape of the fluid product outside the chamber being made through a dispensing channel independent of the button, while in the conventional pump in which the spray is not fixed, the discharge of the product outside the chamber is done usually through the hollow actuating rod which is used from discharge channel towards the push button mounted on the upper extremity of the actuating rod. Every structure of this type of device of the prior art is therefore concerned with the fact that the spray is fixed. The button, the exit valve chamber, as well as the discharge and dispensing channel are of a specific design and little known by comparison with a conventional dispensing device not producing a fixed spray. This structural complexity makes the device relatively costly.

BRIEF SUMMARY OF THE INVENTION

One goal of the present invention is to provide a fixed spray dispensing device for fluid product that may be less costly to manufacture. The invention is proposed to use conventional dispensing devices without fixed spray modified so that their spray is fixed.

To do this, the goal of the present invention is a dispensing device of fluid product contained in a container, said device including:

a pump or a valve of the conventional type including a fixed body in which an actuating rod is movable between a resting position and a dispensing position, said rod being hollow so that it forms a discharge channel providing fluid communication between at least one part of said fluid product and outlets formed on the rod, characterized in that the device includes in addition:

a dispensing member secured on said body, said dispensing member presenting a fixed dispensing outlet and means of communication for providing fluid communication with said movable outlets with the fixed dispensing outlet at least in dispensing position, and a push button mounted on the actuating rod so as to seal the discharge channel at its upper extremity.

In contrast to the devices of the prior art described above, the fluid product is expelled outside the chamber through the discharge channel incorporated in the movable actuating rod. While in the prior art one sought to avoid passing the fluid product through the button or the actuating rod because of their mobility, in the present invention, the fluid passes through the actuating rod allowing the use of conventional dispensing devices that do not produce a fixed spray. This stationary dispensing member allows the spray to be fixed due to fluid communication with the outlet means of the actuating rod.

The actuating rod could or could not be a valve rod with a valve or an actuating rod with a precompression pump. The valve or the pump is an absolutely conventional type and therefore relatively low in cost. Consequently, by simple adaptation of the dispensing member and the push button on the rod, a fixed spray dispensing device is obtained.

According to one form of execution, the communication means include an outlet chamber secured to the dispensing member in which one part of the rod comprising at least the outlet means is mounted so that it can slide in a leaktight manner, said chamber, at least in the dispensing position, causing the outlets of the rod communicate with the dispensing outlet.

Advantageously, the exit chamber surrounds the rod at a height s approximately equal to the height of defined movement between the resting position and the dispensing position of the rod.

In order to guarantee the leaktightness, the exit chamber is provided with two annular leaktight lips in leaktight sliding contact with the rod.

The fluid product discharged by the discharge channel through the outlet means arrives therefore in a chamber sufficiently high to allow it, by means of exit outlets to be at any moment in communication with this exit chamber at least on one part of the movement of the rod up to its dispensing position. In fact, the outlet means according to one form of execution can be at any moment in communication with the exit chamber all along the movement of the rod between the resting position and the dispensing position. In this case, the dispensing device should be provided with an exit valve. As a variation, the outlet means of the rod, can be isolated from the dispensing member in resting position.

In other words, the outlet means of the rod are situated outside the exit chamber in resting position. In this case, the obstruction of the outlet means in resting position acts as exit valve means. With little movement of the rod, the outlet means are therefore hidden. This variation of execution is particularly well adapted in the case where the rod is an actuating rod with a precompression pump, in which a small initial movement of the rod is used to pressurize the fluid product.

Other characteristics and advantages of the present invention will appear during the following detailed description of two forms of execution given by way of nonlimiting example compared with attached drawings.

In the drawings:

DETAILED DESCRIPTION OF THE INVENTION

Figure 1:
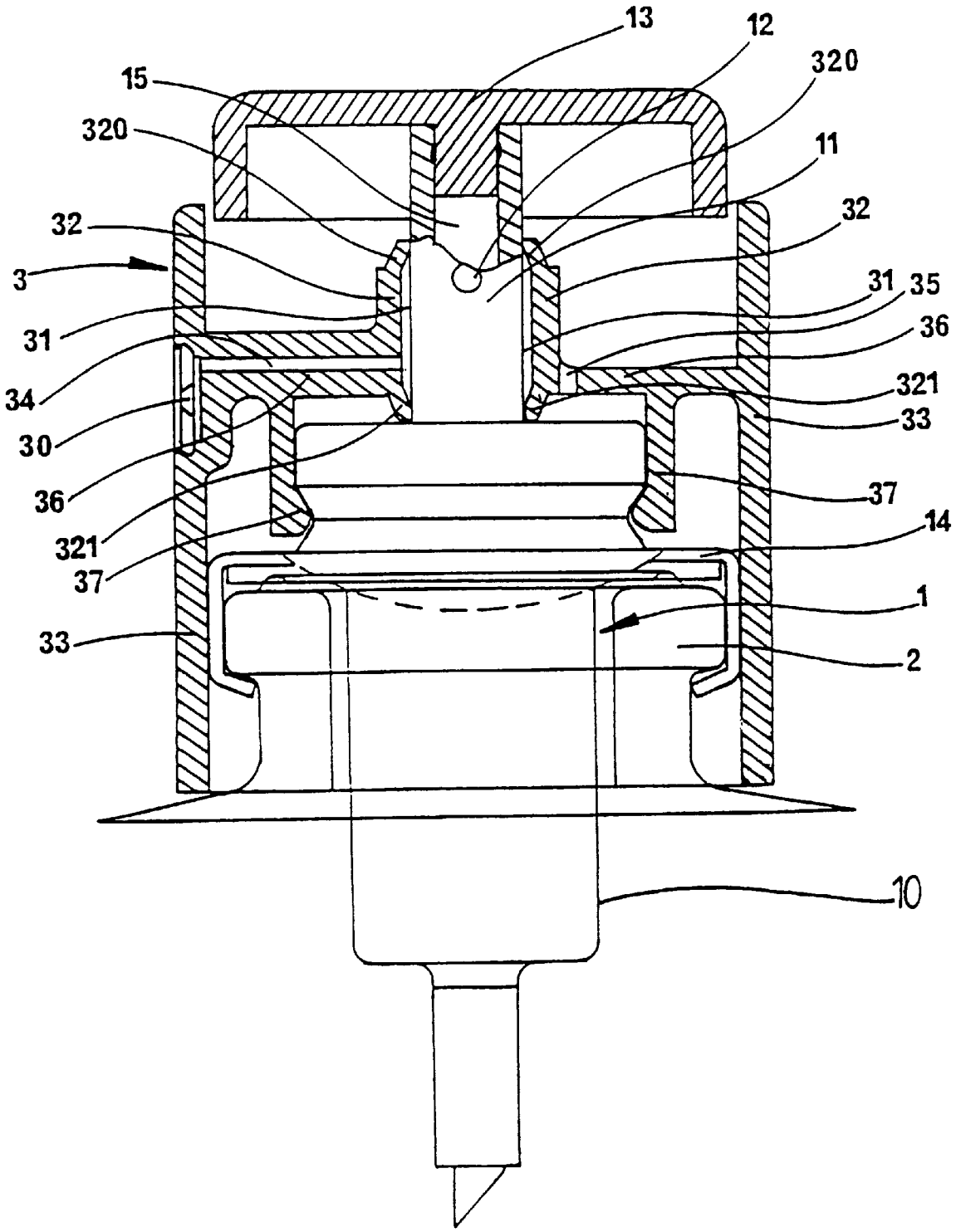
FIG. 1 is a view in section of a dispensing device according to a first form of execution of the present invention.

The present invention is applied to any dispensing device with an actuating rod movable between a resting position and a dispensing position. As dispensing device of this type, simple pumps can be mentioned with or without precompression and measuring valves. In FIG. 1 a dispensing device is represented, designated with the reference number 1, where the internal structure is not visible. It must be understood that it can concerns a pump as well as a valve. As can be seen, the dispensing device 1 is mounted on the neck 2 of a container to which it is fixed by crimping 14. The container may or may not be a pressurized container. The dispensing device 1 includes a fixed body 10 in which an actuating rod 11 with mounted actuating button 13 is movable between a resting position and a sunken dispensing position. The actuating rod 11 is hollow and causes the dispensing chamber to communicate through an internal discharge channel 15 in the case of a pump or a measuring valve, or the container itself in the case of a nonmeasuring valve, with one or several or outlets 12 formed laterally in the actuating rod 11. Conventionally, with each depression of button 13 leading the actuating rod 11 toward its dispensing position, product is discharged by doses, or by continuous jets in the case of a nonmeasuring valve, through the hollow actuating rod 11, then through the outlet(s) 12. It happens that this is an absolutely conventional design for a dispensing device (pump or valve). Therefore, practically any conventional pump and valve currently on the market can be used, with the single condition that they are provided with a hollow actuating rod moving within a fixed body.

According to the invention, a dispensing member is provided, designated in its entirety by the reference number 3, which is mounted on the dispensing device in a stationary or static manner by comparison with the container. That means that the dispensing member is not moved during depression of the push button 13. The dispensing member 3 causes the outlet(s) 12 of the actuating rod 11 to communicate with a dispensing outlet 30 which allows a projection of fluid product in the form of jets of fine sprayed droplets. The dispensing outlet 30 can be of any appropriate nozzle with or without a swirling chamber. In the form of execution represented in FIG. 1, the dispensing member covers the dispensing device with a cylindrical case 33 which extends over the crimping 14 until it is in contact with the base of the neck 2 of the container. This exterior case 33 incorporates the nozzle 30 and also allows depression of the button 13 on the interior of the case until the upper surface of the button 13 is flush with the upper edge of the case 33. The dispensing member 3 comprises in addition an annular brace 36 that extends from the exterior case 33 towards the interior. This annular brace 36 incorporates a dispensing duct 34 which extends from the nozzle 30 towards the interior where it opens into an exit chamber 31 formed by a leaktight mantle 32 which is formed in a single piece with the annular brace 36 and the exterior case 33. The annular brace 36 also incorporates a vent hole 35 that allows entrance of air as fluid product is dispensed in the case of a non-airless pump. Ratcheting fasteners 37 extend from the lower face of the annular brace 36 and are engaged with the dispensing device for constraint of the dispensing member 3 on the dispensing device 1. The ratcheting fasteners 37 must be sufficiently resistant to prevent any movement related to the distribution member 3 by comparison with the dispensing device 1. The dispensing member 1 [sic; 3] is therefore ratcheted on the dispensing device 1.

On the other hand, it is to be noted that the push button 13 acts as a stopper to seal the open upper extremity of the actuating rod, which is normally connected to a conventional dispensing head incorporating a tip or a nozzle. To ensure good leaktightness as well as good maintenance, the push button 13 is ratcheted in the actuating rod; an annular leaktight cord can for example improve the leaktightness.

Also, due to the dispensing member 3 and the push button 13 of the invention, it is possible to transform practically any conventional pump or valve into a fixed spray dispenser, the dispensing member 3 allowing the fluid arising from the mobile actuating rod to be led to the fixed nozzle and the push button allowing the open upper extremity of the discharge channel 15 of the actuating rod 11 to be sealed.

According to an interesting characteristic of the invention, the exit chamber 31 formed by the sleeve 32 is crossed by the actuating rod 11 of the dispensing device 1. As can be seen in FIG. 1, the exit chamber 31 is made leaktight due to two annular leaktight lips 320, 321 which are in leaktight sliding contact with the actuating rod 11. The effective volume of the exit chamber 31 is therefore defined by the annulus formed between the sleeve 32 and the actuating rod 11. In the form of execution of FIG. 1 that is represented in resting position, it can be noted that the outlet(s) 12 of the actuating rod 11 are situated within the exit chamber 31. Consequently, in resting position, the hollow actuating rod 11 is in communication by fluid with the outlet 30 through the outlet(s) 12, the exit chamber 31 and the dispensing duct 34. To allow the actuating of the dispensing device by depression of the button 13, the exit chamber 31 must have sufficient height to allow the outlets 12 to be within the exit chamber 31 when the actuating rod reaches its dispensing position, that is the lowest position. It is essential that the outlet(s) of the actuating rod 11 be situated within the exit chamber 31 at least in the dispensing position. Of course, in the case represented in FIG. 1, where the outlets 12 are situated in the exit chamber 31 in resting position, it is essential that the dispensing device be equipped with an internal exit valve (not shown) to isolate the interior of the dispensing device from the atmosphere. It will be otherwise for the form of execution represented in FIG. 2 that will be described below.

A cycle of actuating will now be rapidly described to understand its operation. In the resting state represented in FIG. 1, the actuating rod 11 is pushed back by internal spring return means on the device (not visible) towards its high resting position. The outlet(s) 12 of the actuating rod 11 are situated in the upper part of the exit chamber 31 and consequently communicate with the dispensing outlet 30 by the chamber 31 and the dispensing duct 34. A push exerted on the push button 13 axially allows the actuating rod 11 to be pushed into the dispensing device, which cause lowering of the outlet(s) 12. According to the type of dispensing device the fluid product is discharged through the actuating rod 11, either from the beginning of the movement of the rod towards its dispensing position, or from a certain length of movement during which no fluid product is dispensed. This is especially the case with a precompression pump in which the product is only dispensed after a certain distance of movement of the actuating rod that allows one to overcome a precompression spring. Be that as it may, when the actuating rod 11 has reached its dispensing position, the interior of the dispensing device must be in communication by fluid with the dispensing outlet 30. Given that the outlet(s) of the actuating rod 11 are permanently situated within exit chamber 31, it can be ensured that the entire fluid product is dispensed through the dispensing outlet 30.

The dispensing member 3 according to the invention allows, due to its exit chamber 31, the effects of the movement of the actuating rod 11 on the jet of sprayed fluid product to be erased at the exit. The dispensing chamber 31' therefore allows the steadiness of the sprayed jet to be reestablished. The steadiness of the jet is particularly appreciated in the case of uses of the dispensing devices in which the precision of the jet is important, as is the case in the pharmaceutical field.

It is also to be noted that the dispensing member of the invention can be adapted to practically any dispensing device with an actuating rod.

By referring now to FIG. 2, a second form of execution will be described in detail according to the invention. This form of execution will show the internal structure of the dispensing device, with the occurrence of a precompression pump. Spring return 17 pushes the actuating rod 11 towards its resting position that is that represented in FIG. 2. The precompression necessary to obtain a good quality of the jet of sprayed product is ensured by a second fixed precompression spring 16. A detailed explanation of the operation of a precompression pump will not be given here, and one can for example refer to document FR-2403465 for more extensive explanations. What is to be noted is that the discharge of the product into such a pump is not produced from the actuating the push button 13 but after a certain distance of movement which allows the fluid product to be put under a determined pressure in the dispensing chamber. The exit valve of such a pump is therefore adapted to be opened only when the pressure in the dispensing chamber of the pump has reached the determined precompression pressure.

Figure 2:
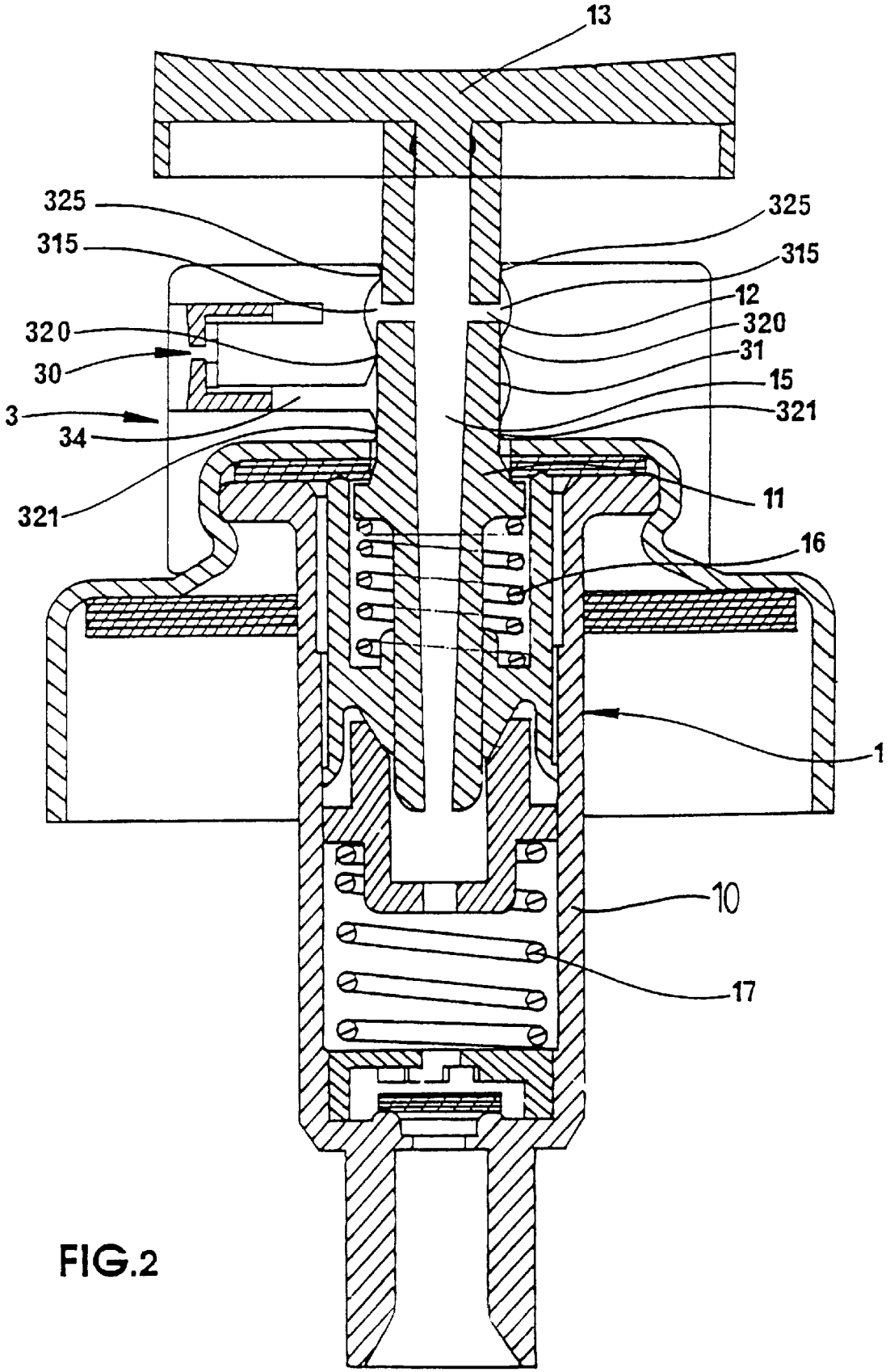
FIG. 2 is view in section of a dispensing device according to a second form of execution of the present invention, showing the internal structure of the device.

In the form of execution represented in FIG. 2, the precompression pump has been slightly modified in that it no longer comprises an exit valve, the function of which is now ensured by the dispensing member 3. In fact, the actuating rod 11 opens directly into the pump chamber. In contrast to the form of execution represented in FIG. 1, the outlet(s) 12 of the actuating rod 11 are not situated in the exit chamber 31 of the distribution member in the resting position. As can be seen in FIG. 2, the outlets 12 are situated, in the resting position, in an isolated chamber 315 closed by two annular airtight lips 320 and 325. Consequently, the outlets 12 of the actuating rod 11 in the resting position are isolated from the exterior by double rows of annular lips 320 and 325. Thus, the isolated chamber 315 fills the function of the chamber of exit valve by isolating the pump chamber from the exterior. The outlets 12 are therefore not positioned in the exit chamber 31 of the dispensing member in the resting position. As can be understood from FIG. 2, the outlets 12 will be in communication with the exit chamber 31 only after the actuating rod 11 has gone a certain distance of movement. The actuating rod 11 must reach the exit chamber 31 with the outlets 12 which is also delimited by a double row of annular lips 320 and 321. The annular lip 320 delimits the separation between valve chamber 315 and the exit chamber 31. It is therefore only when the outlets 12 have cleared the airtight annular lip 320 that the pressurized fluid product in the pump chamber will be discharged through the actuating rod 11, the outlets 12, the exit chamber 31, the dispensing duct 34 and finally the dispensing outlet 30 of the nozzle.

In this particular case illustrated in FIG. 2, the dispensing member of the invention fills therefore a double function: that of exit valve for a precompression pump and that of steadiness of the jet of the sprayed fluid product. As for the push button 13 it also fills here the function of sealer of the discharge channel 15.

We claim:

1. Device for dispensing of fluid product contained in a container, said device including:

a pump or valve mechanism including a fixed body in which an actuating rod is movable between a resting position and a dispensing position, said rod being hollow so that the rod forms a discharge channel providing fluid communication between at least one part of said fluid product and outlets formed on the rod;

a dispensing member secured on said body, said dispensing member presenting a fixed dispensing outlet and communication means for providing fluid communication with said movable outlets with at least the fixed dispensing outlet in dispensing position, the dispensing member being ratcheted on the fixed body, said means of communication comprising an exit chamber secured to the dispensing member in which a part of the rod comprising at least the outlet means is mounted so that it will slid in an airtight manner, said exit chamber causing the outlets of the rod to communicate with the dispensing outlet at least in the dispensing position, said exit chamber having two annular airtight lips in airtight sliding contact with the rod; and a push button mounted on the actuating rod so as to seal the discharge channel at an upper extremity of the discharge channel, the push button being ratcheted on the fixed body.

2. Device for dispensing of fluid product contained in a container, said device including:

a pump or valve mechanism including a fixed body in which an actuating rod is movable between a resting position and a dispensing position, said rod being hollow so that the rod forms a discharge channel providing fluid communication between at least one part of said fluid product and outlets formed on the rod;

a dispensing member secured on said body, said dispensing member presenting a fixed dispensing outlet and communication means for providing fluid communication with said movable outlets with at least the fixed dispensing outlet in dispensing position, the dispensing member being ratcheted on the fixed body, said means of communication comprising an exit chamber secured to the dispensing member in which a part of the rod comprising at least the outlet means is mounted so that it will slid in an airtight manner, said exit chamber causing the outlets of the rod to communicate with the dispensing outlet at least in the dispensing position, said exit chamber surrounding the rod at a height approximately equal to the defined height of the movement between the resting position and the dispensing position of the rod, said exit chamber having two annular airtight lips in sliding contact with the rod; and a push button mounted on the actuating rod so as to seal the discharge channel at an upper extremity of the discharge channel, the push button being ratcheted on the fixed body.

3. Device according to claim 1 or claim 2 in which the outlets of the rod are situated outside the exit chamber.

* * * * *